United States Patent [19]

Dom

[11] 4,387,502

[45] Jun. 14, 1983

[54] SEMI-AUTOMATIC TOOL CHANGER

[75] Inventor: Harry A. Dom, Tiffin, Ohio

[73] Assignee: The National Machinery Company, Tiffin, Ohio

[21] Appl. No.: 251,352

[22] Filed: Apr. 6, 1981

[51] Int. Cl.[3] ..... B23Q 3/157

[52] U.S. Cl. ..... 29/568; 414/591

[58] Field of Search ..... 29/568, 26 A; 414/753, 414/626, 591; 104/93

[56] References Cited

U.S. PATENT DOCUMENTS

| | | | |
|---|---|---|---|
| 1,993,754 | 3/1935 | Smith et al. | 414/626 |
| 3,422,967 | 1/1969 | Aron | 414/753 |
| 3,647,090 | 3/1972 | Suzuki | 29/568 X |
| 3,651,758 | 3/1972 | Evans et al. | 414/753 X |
| 3,818,580 | 6/1974 | Pagella et al. | 29/568 |
| 4,188,815 | 2/1980 | Mizushima | 29/568 X |
| 4,281,447 | 8/1981 | Miller | 29/568 |
| 4,302,144 | 11/1981 | Hallqvist | 29/568 X |
| 4,304,041 | 12/1981 | Kline | 29/568 |

FOREIGN PATENT DOCUMENTS

| | | | |
|---|---|---|---|
| 2844509 | 4/1979 | Fed. Rep. of Germany | 29/568 |
| 404602 | 3/1974 | U.S.S.R. | 29/568 |

*Primary Examiner*—William R. Briggs

*Attorney, Agent, or Firm*—Hearne, Gordon, Sessions, McCoy, Granger & Tilberry

[57] ABSTRACT

A tool changer for forging machines or the like is disclosed. The tool changer includes a carriage which is manually movable along a track between positions over a forging machine and a position over a tool storage area. Detents are provided to give an indication when the carriage is properly positioned at each station where a tool changing operation is required. A power lift supported by the carriage is turn supports a tool head for vertical movement. Mounted on the lift is a tiller which extends laterally from the tool changer. Controls for the lift are mounted on the tiller. The tiller and the controls mounted thereon are conveniently located to permit the operator to move the tool changer from an operator's position intermediate the machine and tool storage area and to control the operation of the tool changer from such position. A camming system operates to accurately position the tool changing head as it is lowered into an operative position at each work station.

6 Claims, 8 Drawing Figures

20
25
62
63
79
106
107
108
109
111
112
113
114
116
117
118
119
123
124
126
127
128
129
131
132
133
134
136
137
138
139
26

SEMI-AUTOMATIC TOOL CHANGER

BACKGROUND OF THE INVENTION

This invention relates generally to tool changers, and more particularly to a novel and improved tool changing apparatus for forging machines or the like.

PRIOR ART

The pending U.S. patent application Ser. No. 109,474, filed Jan. 4, 1980 (assigned to the assignee of the present invention), discloses a fully automated tool changer for forging machines or the like. Such tool changer is operable to automatically change selected tools or an entire set of tooling. It utilizes a programmable mechanical robot for moving a tool handling head between selected locations at the machine where the tools are secured for removal and where replacement tools are subsequently installed and selected locations at the tool storage area where removed tools are deposited and replacement tools are secured for subsequent installation in the machine.

In such tool changer, locating means are provided on the machine and at the tool storage area to accurately locate the tool handling head. Such locating means provide cams which operate, after rough location of the head by the transfer, to precisely position the head during tool removal and replacement. In addition, such locating means provide direct support for the head so that the power transfer does not have to absorb the loads or forces resulting from the actual removal and installation of the tooling. Such pending application Ser. No. 109,474 is incorporated herein in its entirety.

Because the system of such tool changer is fully automated, it requires relatively elaborate servo-feedback systems and relatively elaborate programmable controls, both of which substantially increase the complexity and cost of the system. Therefore, the market for such system is limited to relatively elaborate installations in which such cost and complexity are justified.

SUMMARY OF THE INVENTION

The present invention is directed to a tool changer for forging machines or the like in which many of the advantages of the above-described, fully automated system are provided, but in which the system controls are greatly simplified. With the present system, an operator controls the operation of the tool changer and the need for elaborate servo-feedback systems and programmable controls is eliminated. Consequently, with the present invention, the tool changer is substantially less complicated and substantially less expensive than the tool changer of the fully automated system. Therefore, the system of this invention has application in many installations which would not justify the installation of such fully automated system.

In the illustrated embodiment, a powered lift is carried on a track-mounted carriage between the machine and the tool storage area. Mounted on the lift is a tool handling head similar to the tool handling head of the pending application, supra. The tool handling head of this invention, however, is modified to some extent to simplify its structure and operation without materially changing its function.

The carriage is manually movable between the tool storage area and the machine, and is provided with locaters which permit the operator to accurately position the carriage, and in turn the head, at the various locations for changing of selected tools.

A "tiller" is provided to allow the operator to move the carriage back and forth from a single convenient location between the machine and the tool storage area so that it is not necessary for the operator to work over the machine or the tool storage area. Further, the operator controls are located on the tiller where they can be conveniently reached by the operator at all times.

Novel camming means are also provided to accurately position the tool handling head for its operation without requiring excessively accurate positioning of the carriage or the lift.

With the present invention, all of the tool changing operations which require substantial effort are performed by power means under the control of the operator. Therefore, the physical effort required to operate the changer is minimal.

These and other aspects of this invention are fully illustrated and described in the drawings and in the following detailed description thereof.

DETAILED DESCRIPTION OF THE DRAWINGS

Figure 1:
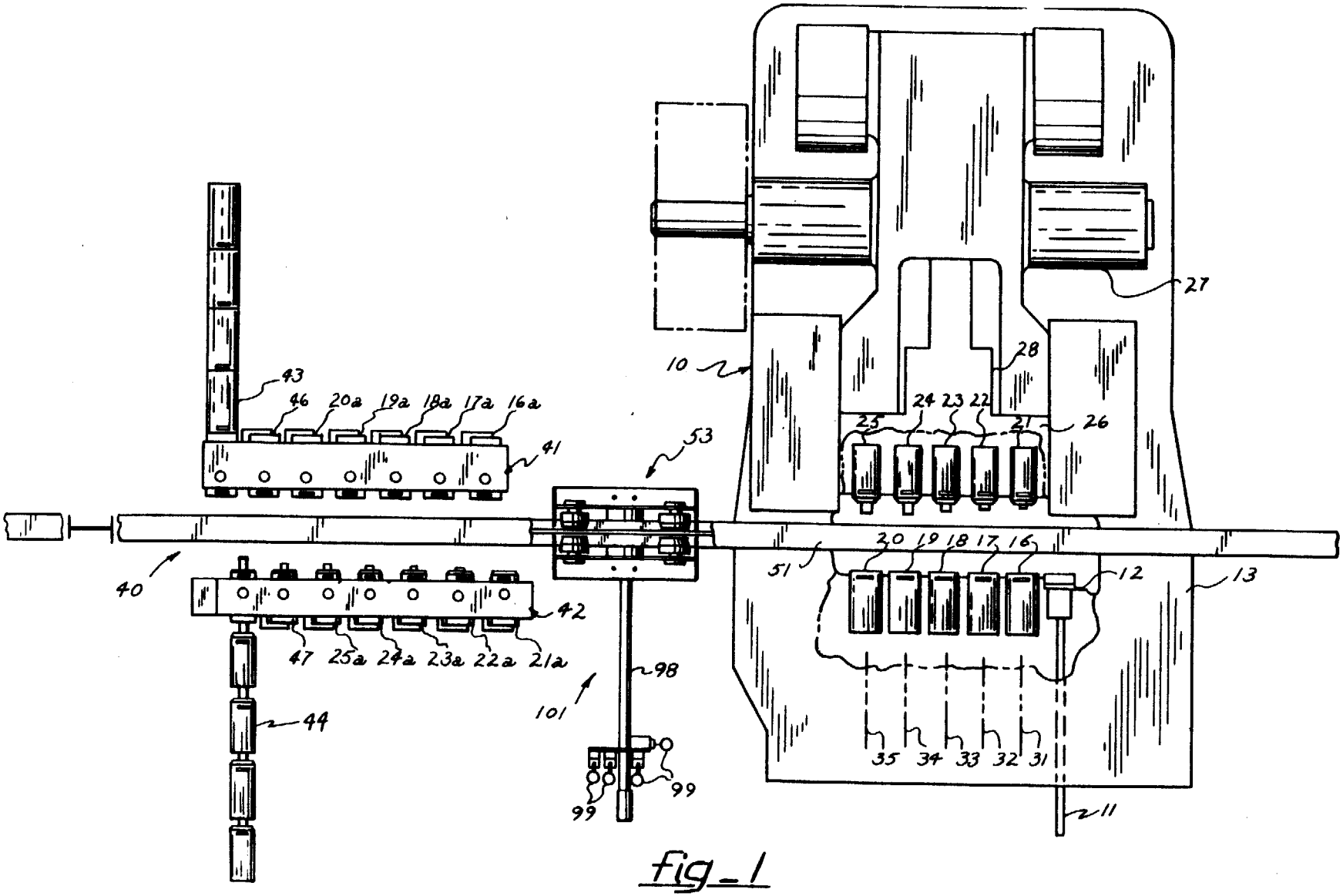
FIG. 1 is a plan view of the overall system illustrating a typical forging machine and the tool storage zone adjacent thereto and also illustrating the tool changing carriage in a midposition between the two.

Referring to FIG. 1, the present invention is illustrated as applied to a conventional multi-station forging machine 10 of the type in which stock 11 is fed to a cutter 12. The cutter shears individual workpieces from the stock for subsequent forming operations. The illustrated machine is commonly referred to as a "progressive former" in that blanks or workpieces cut from the wire stock are progressively positioned at each of a plurality of work stations in which they are progressively formed to the desired shape. Such machine may be, for example, a cold former, a hot former, a header, or any other conventional type of forging machine.

Such machine includes a plurality of dies 16 through 20 which are mounted in the die breast portion of the machine frame 13 and associated tools 21 through 25 mounted on a reciprocating slide 26. Usually the slide is driven by a crank 27 and pitman 28 for reciprocating movement toward and away from the dies which cooperate, in the illustrated machine, to provide five work stations 31 through 35 along the indicated centerlines. A transfer (not illustrated) operates to progressively transfer the workpieces from the cutter 12 to each of the work stations 31 through 35 where the workpieces progressively form to the desired shape.

United States Pat. No. 2,542,864 schematically illustrates an example of an overall arrangement of one type of forging machine of the general type to which the present invention is applicable. However, it should be understood that the present invention is applicable to other types of machines, and that, except insofar as defined in the claims the specific structural arrangement of the machine is not critical to the present invention.

Located in a tool storage area 40 at a convenient location adjacent to the machine are tool storage racks 41 and 42. The rack 41 is structured with die cavities to receive replacement dies 16*a* through 20*a*. The rack 41 is also provided with a tubular cavity 43 in which the dies 16 through 20 are positioned when they are removed from the machine 10. In the illustrated embodiment, such tube is arranged to receive the dies in endwise relationship and is sufficiently long to accommodate all of the dies as they are removed from the machine.

Replacement tools 21*a* through 25*a* are supported in a similar manner in the tooling rack 42 and are also transferable by the tool changer to replace the respective tools 21 through 25. Here again, the tool rack 42 is provided with an elongated tubular cavity 44 to receive the tools 21 through 25 as they are removed from the machine during a tool changing operation.

In addition to the tooling 16*a* through 25*a*, flushing heads 46 and 47 are respectively positioned in the tooling racks 41 and 42. Such flushing heads are used to ensure that the tool and die cavities are clean and ready to receive new tooling during the tool changing operation. Normally, the desired replacement tooling is positioned in the tooling racks 41 and 42 while the machine is operating so that when a tool change is required, the tooling is ready to be installed when the installed tooling is removed.

A track 51, which in the illustrated embodiment is an I beam, extends over the machine 10 and over the tool storage area 40. The tool changer 53 is supported on the track 51 for horizontal movement back and forth between the machine 10 and the tool supply area 40.

Figure 2:
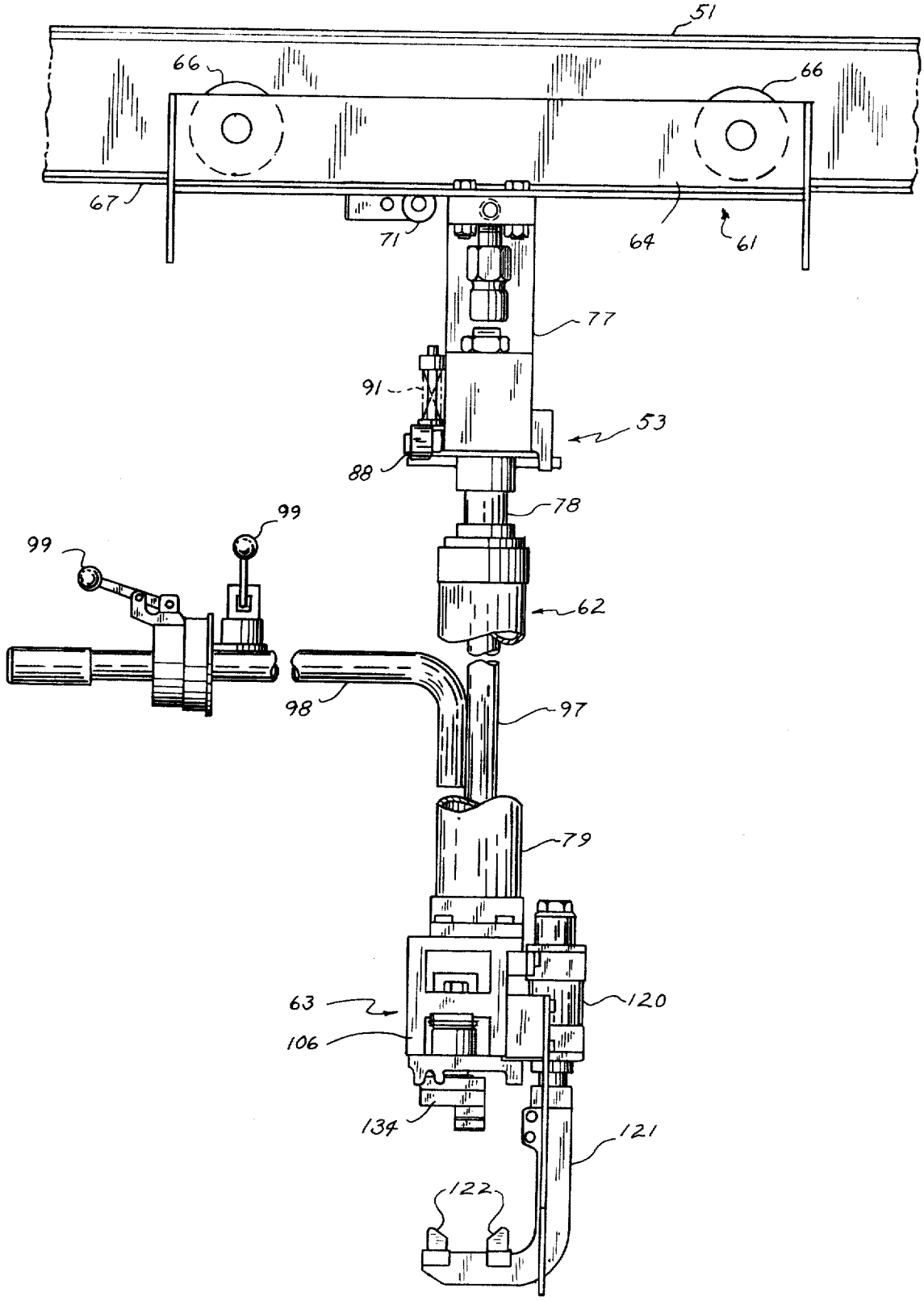
FIG. 2 is a broken side elevation of the tool changing apparatus illustrating the track-mounted carriage, the power lift, and the tool handling head.

As best illustrated in FIG. 2, the tool changer 53 includes three subassemblies, a trolley or carriage 61 which is supported by the track 51 for horizontal movement between the machine 10 and the tool storage area 40, a power lift 62, and a tool changing head 63, which is supported by the power lift 62 and is vertically movable thereby.

Figure 3:
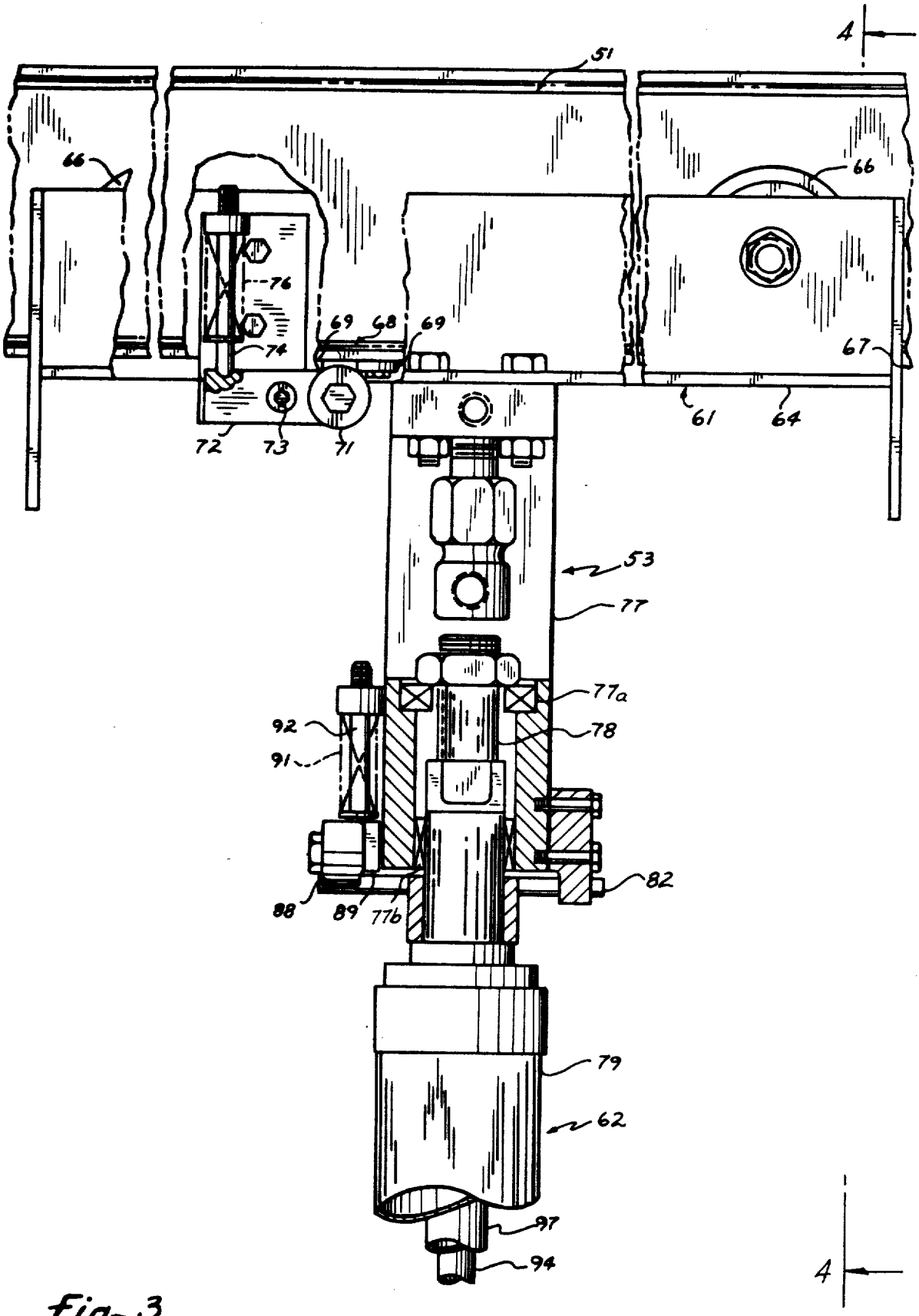
FIG. 3 is an enlarged, fragmentary view of the carriage illustrating the locating detent structure and the mounting of the lift on the carriage.
Figures 4, 5:
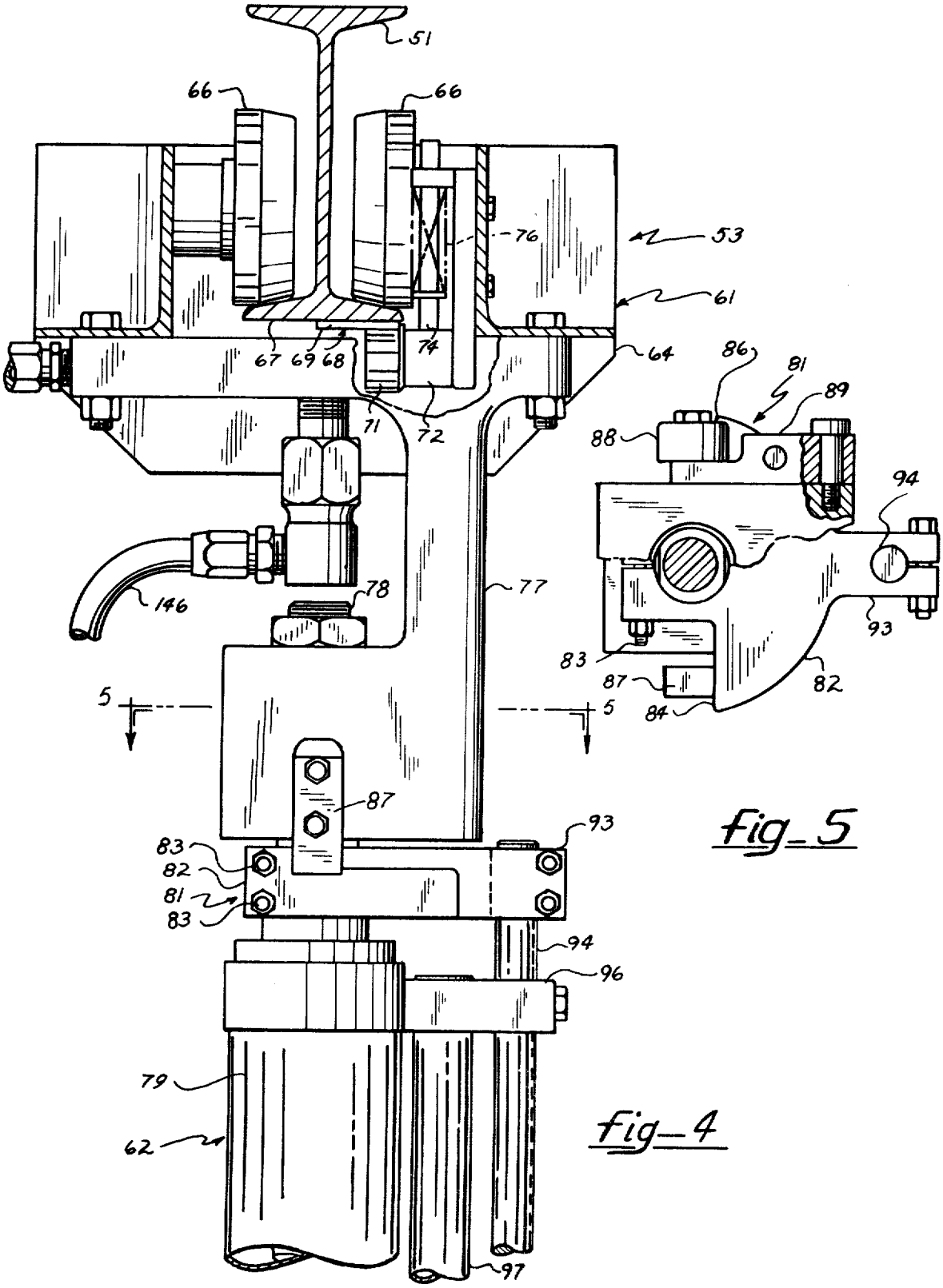
FIG. 4 is a view taken generally along line 4—4 of FIG. 3.
FIG. 5 is a fragmentary section of the apparatus for establishing the proper rotary position of the lift with respect to the carriage, taken generally along line 5—5 of FIG. 4.

The structural detail of the trolley or carriage 61 is best understood by referring to FIGS. 3 and 4. Such carriage includes a carriage frame 64 having spaced pairs of support rollers 66 which engage the lower flange 67 of the track 51, as best illustrated in FIG. 4, and support the carriage 61 for horizontal movement along the track 51 between the storage area 40 and the machine 10.

Detent locater means 68 are provided on the track 51 at positions corresponding to each of the five work stations 31–35 and also corresponding to each of the pick-up and delivery positions in the tool storage area 40. Each detent locater means includes a pair of spaced blocks 69 secured to the underside of the lower flange 67 and positioned for engagement by a spring-loaded detent roller 71. As illustrated in FIG. 3, the detent roller 71 is mounted on a support link 72, which is in turn pivoted at 73 on the carriage frame 64. A plunger 74 engages the opposite end of the support link 73, and is biased by a spring 76 to resiliently urge the detent roller 71 in an upward direction, as illustrated in FIG. 3.

As the carriage 61 is rolled along the track 51, it engages the underside of the flange 67 until it encounters one of the spaced detent blocks 69. Upon engagement of the detent block 69, the roller 71 is biased downward against the action of the spring 67 until it reaches a location corresponding to the space between a pair of blocks, where it snaps back up to the position illustrated in FIG. 3. In such position, the detent roller 71 resists movement of the carriage in both directions, and provides the tool changer operator with a positive feel that the carriage is in proper position for one of the tool changing operations. With this detent structure, the operator is provided with a positive indication that the carriage is in one of the positions along the track in which a tool changing operation is to be performed. The operator can visually determine that the tool changer is in position corresponding to the desired tool changing operation and the detent provides accurate locating indications to assist the operator in properly positioning the tool changer.

Depending from the carriage frame 64 is a lift support member 77 on which the power lift 62 is mounted. In the first illustrated embodiment, the power lift includes a piston and cylinder actuator having a piston 78 supported on a pair of spaced bearings 77*a* and 77*b* mounted on the lift support 77 so that the piston is vertically supported by the support 77 but is journaled for rotation with respect thereto. The vertically movable element of the power lift is the cylinder 79 into which the piston 78 projects. The piston and cylinder coact when fluid pressure is appropriately supplied thereto to raise and lower the tool changing head directly mounted on the lower end of the cylinder 79.

An indexing mechanism 81 is provided between the lift support 77 and the cylinder 79, which allows rotation of the power lift with respect to the lift support 77 through 180 degrees as the tool changer is moved between the tool storage area 40 and the machine 10.

The indexing means 81 is best illustrated in FIGS. 4 and 5, and includes a plate 82 secured to the piston 78 by clamp bolts 83 for rotation therewith. The plate 82 is provided with two stop surfaces 84 and 86, which respectively engage opposite sides of a depending stop element 87 mounted on the lift support when the lift is rotated through 180 degrees with respect to the lift support 77 to limit the rotative movement to operative positions 180 degrees of rotation apart. In order to retain the lift cylinder in either of its two operative positions, a detent roller 88 is mounted on a spring-biased pivot arm 89. A spring 91 (illustrated in FIG. 3) acts through a plunger 92 to provide the biasing force on the detent roller 88. The detent roller is supported on the lift support 77 at a position diametrically opposite the stop element so that when the stop surface 84 engages one side of the stop element 87, the detent roller engages the edge of the opposite stop surface 86 and provides a biasing force tending to maintain the stop surface 84 in engagement with the stop element 87. When the lift is rotated through 180 degrees from the position illustrated in FIG. 5 in an anticlockwise direction, the detent roller is cammed up onto the surface of the plate 84 and rolls along such surface until the stop surface 86 engages the opposite side of the stop element 87. In such position, the roller 88 rolls over the edge of the stop surface 84 to again provide a spring bias tending to retain the stop surface 86 in engagement with the stop element 87.

The plate 82 is also provided with an extension 93 in which the upper end of a guide rod 94 is clamped. Such rod functions to prevent relative rotation between the piston 78 of the lift and the cylinder 79. The guide rod 94 extends through a guide block 96 mounted on the cylinder 79 with a sliding fit, so that the cylinder is free to move up and down with respect to the piston but is restrained against rotation relative thereto.

A manifold tube 97 is also secured at its upper end in the guide block 96 and extends down along the side of the cylinder 79 to its lower end, where it is also secured to the cylinder 79. As illustrated in FIG. 2, a laterally projecting tiller 98 is secured to the manifold tube 97 and extends laterally of the lift, as best illustrated in FIG. 1. Mounted on the tiller substantially adjacent to its end are the various control valves 99 used by the operator to control the operation of the tool changer, as described in detail below. The tiller 98 permits the tool changer operator to manually move the tool changer along the track 51 between the various tool changing positions both at the machine 10 and the storage area 40. During such movement, the operator remains in an operator position 101 between the machine 10 and the tool storage area 40, and moves the tool changer out over each of the machine and the tool storage areas without leaving the operator position 101 between the two. Consequently, it is not necessary for the operator to work out over either the machine 10 or the tool storage area 40.

During such traversing movement of the tool changer, however, the tool changer is rotated through 180 degrees by the tiller 98. When the tool changer is over the machine, the tiller extends back along the track 51 in a direction towards the tool storage area so that the control valves 99 and the end of the tiller are located adjacent to the side of the machine. Conversely, when the tool changer is located over the tool storage area, the tiller 98 extends in the opposite direction towards the machine, so that the control valves and the end of the tiller are located in the operator's position convenient to the operator.

The indexing mechanism 81, including the detent roller 88 and the stop element 87, provide the operator with a feel when the lift 61 has been rotated through 180 degrees to the proper position for tool changing operations. Similarly, the action of the detent roller 71 on the carriage 61 provides the operator with an indication that the tool changer is at a proper location along the track 51 for the tool changing operation.

Figure 6:
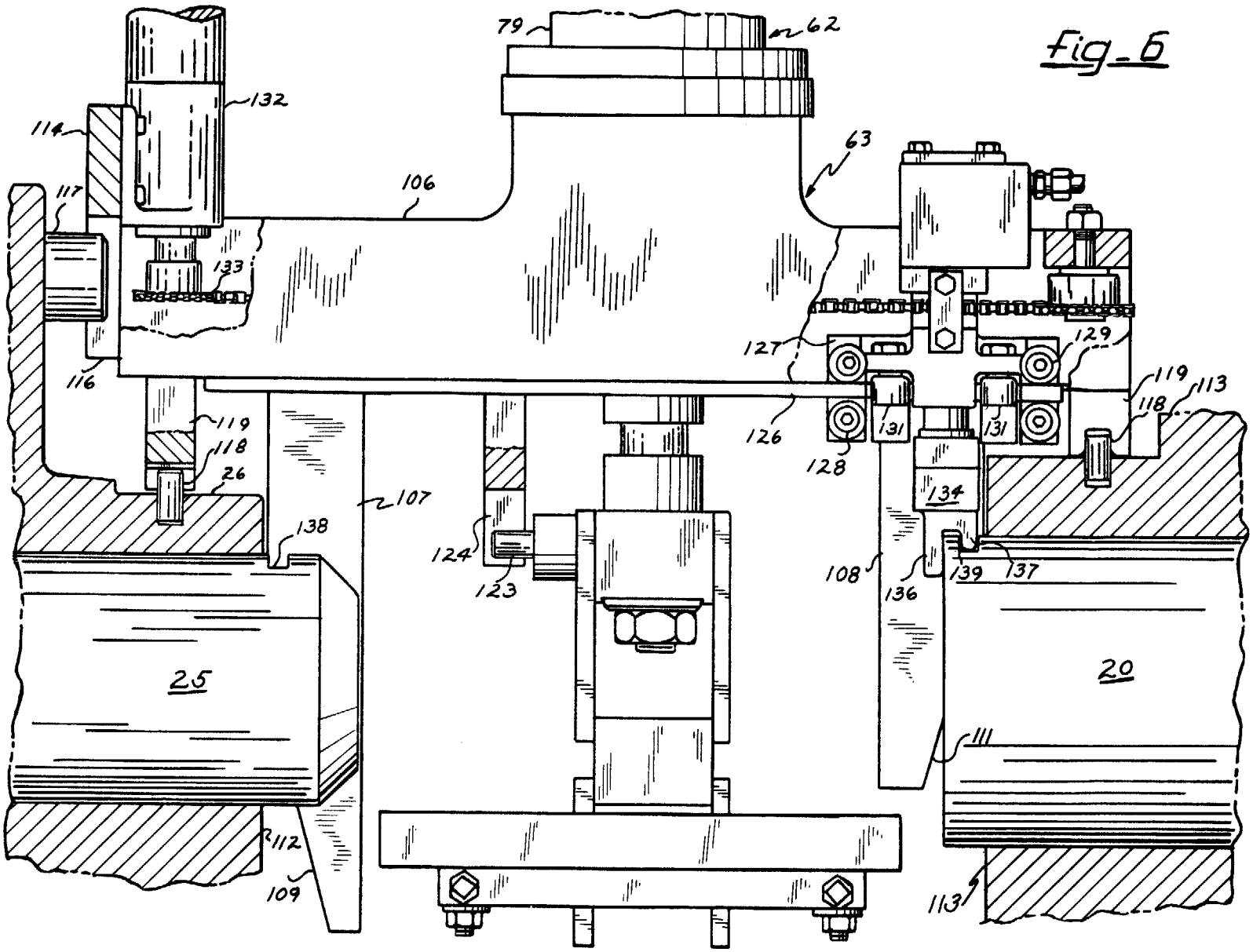
FIG. 6 is a side elevation of the tool changing head, partially in section, illustrating the tool support and the mechanism for withdrawing tooling from an installed position and for inserting tooling to the installed position.
Figure 7:
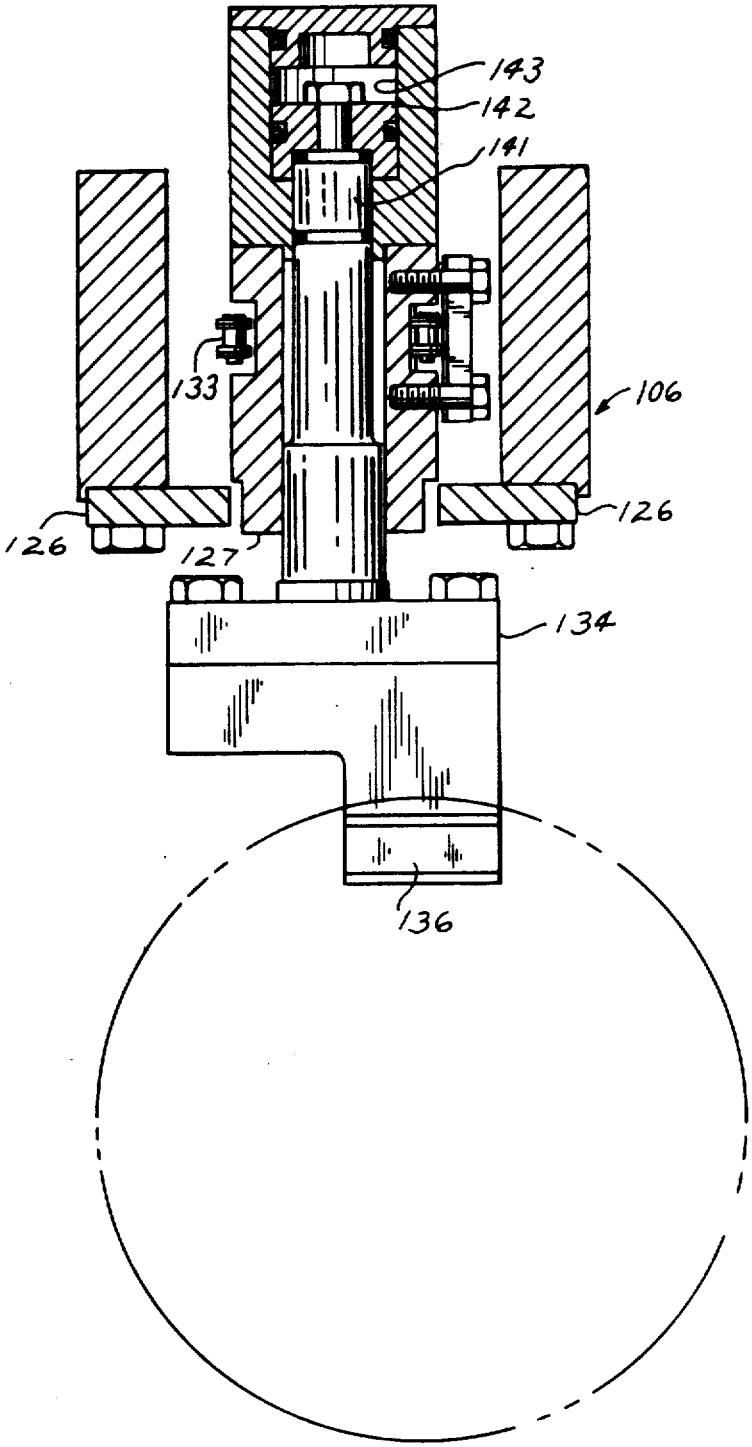
FIG. 7 is a fragmentary section illustrating the apparatus for raising the tool engaging element.

The tool changing head 63 is best illustrated in FIGS. 2, 6, and 7. The head 63 includes a frame 106 secured to the lower end of the cylinder 79. Depending from the frame 63 are a pair of opposed, first cam elements 107 and 108, respectively providing inclined camming surfaces 109 and 111. As the tool changing head is lowered into position at the selected of the die stations, the camming element 107 fits down adjacent to the forward face 112 of the slide 26 and the camming element 108 fits down along the forward face 113 of the die breast portion of the machine frame 13.

Prior to the tool changing operation, the slide is positioned in its back dead-center position so that a predetermined spaced is provided between the two faces 112 and 113. If any significant misalignment exists between the tool changing head 63 and the space between the two faces 112 and 113, the inclined camming surfaces 109 and 111 act to cam the tool changing head laterally, as viewed in FIG. 6, into position in the direction of the principal axis of the machine. Similarly, a cam block 114 mounted on the head 63 is formed with a downwardly open, V-shaped opening 116, which fits over a pin 117 on the slide 26 to cam the head into proper position in a direction perpendicular to the plane of FIG. 6 as the head is lowered into an operative position. Therefore, the camming elements 107 and 108 operate to position the head in one plane and the cam block 114 operates to position the head in a perpendicular plane.

The final positioning of the head with respect to the tooling is accomplished by three pins 118 provided on the machine (only two of such pins appear in the drawings). Such pins project into associated slots provided on projections 119 to accurately position the head and to maintain the head in proper position during the tool changing operation. Reference should be made to the copending application, supra, for a more detailed description of the manner in which the pins 118 and the slotted projections 119 are arranged and function. The lower ends of the slots in the projections 119 are flared and function as secondary cams to accurately position the head as it moves to its final operative position. Further, the pins and slots coact to position the head during the tool changing operation so that proper head position is maintained and the forces resulting from tooling removal and insertion are not transmitted to the lift 62 or carriage 61.

Mounted on the frame 106 of the head 63 is a vertically movable tool support 121 having a pair of spaced and parallel tool support elements 122, which support the tools on the head as they are transported between the machine and the tool storage area. A piston and cylinder support 120 is provided to move the tool support 121 between a raised and lowered position so that it can accommodate tools of two different sizes. In the illustrated embodiment, the dies 16 through 20 have a diameter greater than the diameter of the tools 21 through 25. Therefore, the tool support 121 is lowered to align the support elements 122 with the dies 16 through 20 when such dies must be changed, and is raised up to its upper position for proper alignment with the tools 21 through 25. A lateral pin 123 and guide 124 prevent rotation of the tool support 121 with respect to the head.

Mounted on the tool changing head 63 are a pair of opposed tracks 126 which support a carriage 127 for movement back and forth along the tool head. Such carriage is provided with opposed pairs of rollers 128 and 129 and side rollers 131. The carriage 127 is powered for reciprocation back and forth across the tool changing head by a motor 132, which may be an air motor or the like. Such motor is connected to the carriage through a chain drive 133.

Depending from the carriage 127 is a tool engaging element 134 having two spaced, depending fingers 136 and 137. The finger 136 is proportioned to fit into a mating groove 138 formed in each of the tools 21 through 25. The finger 137 is proportioned to fit into a groove 139 formed in each of the dies 16 through 20. The tool engaging element 134 is mounted for limited vertical movement with respect to the tool head by an actuator system, best illustrated in FIG. 7. Such actuator system includes a piston 141 having a piston head 142 within a cylinder 143. When the piston is extended as illustrated in FIG. 7, the tool engaging element is in its downward or operative position. However, when the piston is retracted, the tool engaging element is lifted from its operative position.

The tools are releasably locked within the slide 26 by apparatus described in detail in the copending application incorporated by reference, supra, and reference to such application should be made for the details of the tool locking system. Similarly, a tool locking system is provided for each of the dies for releasably locking the dies in the die breast portion of the frame. Here again, reference should be made to the copending application for a detailed description of such apparatus.

The locking apparatus for the dies is also arranged to partially eject the die to the position illustrated in FIG. 6, in which the groove 139 is accessible to the finger 137. In the fully installed position, the face of the die 20 is essentially aligned with the face 113 of the die breast portion of the frame 13.

By providing a system in which the cylinder 79 is raised and lowered, and in which the piston is fixed, it is not necessary to provide multiple supply hoses from the carriage 61 to the controls. Instead, a single flexible pressure line 146 (see FIG. 4) extends from the carriage 61 to the manifold tube 97 and from such tube to the various control valves 99 provided on the tiller. From the valves, it is not necessary to provide flexible pressure lines to the drive motor 132, the cylinder 120, or the cylinder 79 because there is no relative movement between the corresponding valves and these actuators. It is, however, necessary to provide one flexible line on the tool changing head connecting the cylinder 143 to its corresponding valve. Such system in which the need for flexible lines is minimized tends to reduce the likelihood of maintenance problems.

Full control of the change is provided by the valves 99 mounted on the end of the tiller 98. For example, one valve 99 is connected to the lift cylinder 79 to raise and lower the head. Another valve 99 is connected to the piston and cylinder support 120 which controls the position of the supports 122. A third valve 99 controls the operation of the motor 132 which powers the carriage. A fourth valve 99 controls the raising and lowering of the fingers 136 and 137.

A tool changing operation is performed substantially as follows. When it is desired to remove a particular die, such as the die 20, the die is unlocked and is partially ejected from the machine to the position illustrated in FIG. 6. The operator moves the tool changer carriage along the track 51 until the carriage detent corresponding to the work station 35 is reached. During the movement of the tool changer to such position, the tool changer is indexed to the proper position by rotating the tiller, and in turn the lift cylinder and head, to the position for removal of the tooling from the machine.

The power lift is then operated to lower the tool head into its operative position, and the cam elements 107 and 108 correct any misalignment which might occur in one plane as the head is lowered and the cam block 114 operates to correct any substantial misalignment in the perpendicular plane. These cams function to provide sufficiently accurate positioning of the tool changing head so that the respective pins 118 will engage the flared openings in associated grooved projections 119 for final positioning of the head.

Prior to the lowering of the head, the carriage 127 is positioned at the extreme of its travel toward the die so that the finger 137 is automatically positioned within the groove 139 as the head reaches its operative position. Further, the tool support is lowered to properly position the tool support element 122 to receive the die 20.

When the head is properly positioned, the motor 132 is operated to move the carriage 127 to the left, as viewed in FIG. 6, to withdraw the die from the die breast and onto the tool support. The lift is then operated to raise the head, with the tool 20 supported thereon, until it is cleared for movement to the tool storage area where the tool changer is aligned with the tube 43 and is properly located before such tube. Here again, detents on the track 51 provide an indication to the operator that the tool changer is properly positioned to deposit the removed dies in the tube 43.

During the traversing movement from the machine to the tool storage area, which is manually accomplished by the operator through the use of the tiller 98, the tool changing head is rotated through 180 degrees to properly position the head with rspect to the tube 43. The motor 32 is then again operated to push the die 20 from the tool changing head into the tube 43, where it is released. If a flushing operation is to be performed, the tool changer is moved to the position to pick up the flushing head 46 and to transport such head to the work station 35, where it is inserted and operated to flush the die cavity in the manner described in copending application, supra.

After the flushing head is redeposited in the tool storage area, the carriage is moved to a position to pick up the replacement tool **20*a*. Here again, pins 118*a* are provided to assure proper location of the tool head for picking up the replacement die 20*a*. When the head is lowered into position, the finger 137 engages the groove 139 of the tool 20*a*, and the motor 132 is operated to move the die 20*a* out of the tool storage rack 41 onto the support elements 122**.

The power lift is then raised and the tool changer is traversed back to the position of the work station 35, and during such traverse is again rotated through 180 degrees so that the die supported by the tool changing head is properly positioned to be inserted into the die cavity at such work station. The head is then lowered and positioned in the manner previously described so that the die **20*a* resting on the tool changing head is properly positioned for insertion into the then empty die cavity. The motor 132 is then operated to cause the carriage 127** to move to the right, as viewed in FIG. 6, and this causes the die to be pushed into the die cavity to the position of FIG. 6.

As mentioned above, this is not the fully installed position. Completion of installation is accomplished by raising the tool engaging element 134 to lift the finger 137 clear of the groove 139 and the carriage is moved to the left as viewed in FIG. 6 from the illustrated position until the finger 137 is past the face of the die. The tool engaging element is then again lowered so that the finger 137 is in alignment with the face of the replacement die. The carriage is then operated to the right, and the die is pushed into its final installed position. Because the tool engaging element 134 can be raised with respect to the tool changing head, it is not necessary to raise the tool changing head for this last insertion operation.

A similar procedure is followed for removing and replacing tools 21 through 25. However, in the instance of the tools, the groove 138 is fully exposed when the tool is fully installed in the slide 26, so it is not necessary to partially eject the tools before the carriage is lowered to engage the finger 36 with the grooves 38. Similarly, on reinstallation, a single traverse of the carriage 127 to the left completes the full insertion of the tool into its associated tool cavity.

Figure 8:
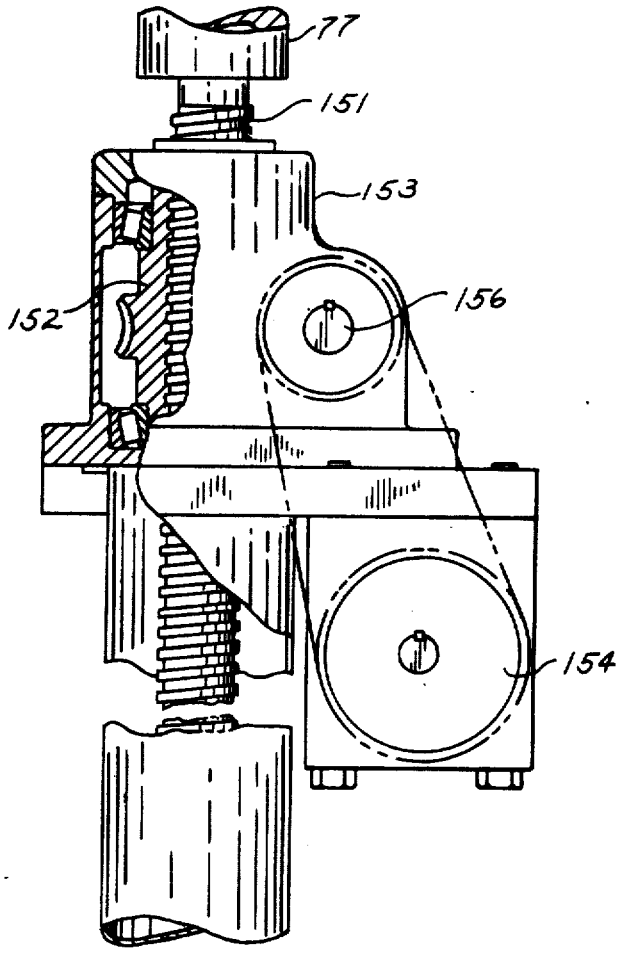
FIG. 8 is a fragmentary side elevation of a second form of power lift utilizing a mechanical screw actuator instead of a piston and cylinder actuator.

FIG. 8 discloses a second embodiment in which the power lift employs a screw-and-nut actuator instead of a piston-and-cylinder actuator. In such structure, a screw 151 is mounted on the lift support 77 in the same manner as the piston of the first embodiment, and a nut 152 is journaled in a housing 153 corresponding to the cylinder. The tool changing head is mounted on the housing. In this embodiment, an air motor 154 is mounted on the housing 153 and connected to a chain drive, to a worm gear 156, which in turn meshes with peripheral gear teeth on a nut to rotate the nut with respect to the housing for raising and lowering the housing to raise and lower the tool changing head.

In this embodiment having a screw and nut, the lift will remain in a fixed position without pressure once the motor is stopped.

In some instances, it may be desirable to arrange the tool changing head so that it does not rotate about a vertical axis through 180 degrees during the traversing movement. In such instances, the tiller itself is pivotally supported on the power lift, and the tiller rotates through approximately 180 degrees during the traverse of the tool changer but the tool changing head does not turn.

With the present invention, a powered tool changer is provided which allows an operator to easily and conveniently replace tooling in a forging machine or the like. With the illustrated apparatus, it is not necessary to provide servo mechanisms to position the tool changer during its operation. The detents on the track provide the operator with an indication that the carriage of the tool changer is properly positioned and the cams operate automatically to provide the final positioning of the tool changing head as it is lowered into operative position. Further, the final positioning of the tool changing head is automatically accomplished by the pins located on the machine and on the tool storage racks. In addition, the forces involved during the removal and installation of the tooling are directly absorbed by the tool changing head. Because the controls for the tool changer are provided on a tiller which is conveniently accessible to the operator in all operative positions of the changer, it is not necessary for the operator to work over either the machine or the tool storage area.

With a tool changer in accordance with the present invention, a relatively simple apparatus is provided which can be easily operated to change tooling even in large forging machines or the like.

Although preferred embodiments of this invention have been shown and described, it should be understood that various modifications and rearrangements of parts may be resorted to without departing from the scope of the invention as disclosed and claimed herein.

What is claimed is:

1. A tool changer for forging machines or the like comprising a machine providing tools at a plurality of spaced work stations, a tool supply adjacent to said machine providing replacement tools at a plurality of spaced storage stations, said tool changer providing a horizontally movable carriage movable on support means between said machine and said supply, a power lift supported by said carriage for movement therewith, a tool handling head supported by said lift for vertical movement thereby, a plurality of locater means positioned to be associated with said work and storage stations providing an indication when said carriage is positioned over each of said work stations and each of said storage stations for positioning said tool changer at each station, first and second cam means operable to position said head with respect to said stations as said head is lowered by said lift, said first cam means operating first to ensure relatively close positioning of said head, and said second cam means operating to thereafter provide final positioning of said head.

2. A tool changer as set forth in claim 1, wherein said locater means are detents which engage when said carriage is positioned at each station, said carriage being manually movable between said stations, and said detents providing a feel indicating when said carriage is positioned at each station.

3. A tool changer as set forth in claim 2, wherein a laterally extending tiller is mounted on said lift permitting an operator to move said carriage back and forth over said machine and said tool supply from an operator's position therebetween.

4. A tool changer as set forth in claim 3, wherein controls for said lift and tool handling head are located on said tiller for operation at said operator's position.

5. A tool changer as set forth in claim 4, wherein said lift and tool handling head are power-operated, said lift providing telescoping first and second members, said first member being mounted on said carriage, said second member being vertically movable relative to said first member, said tool handling head being supported on said second member for vertical movement therewith, said controls for said lift and tool handling head being supported on said second member, and a flexible power supply connected to said controls provides the power for operating said lift and tool handling head.

6. A tool changer as set forth in claim 1, wherein said lift and tool handling head are power-operated, said lift providing telescoping first and second members, said first member being mounted on said carriage, said second member being vertically movable relative to said first member, said tool handling head being supported on said second member for vertical movement therewith, controls for said lift and tool handling head mounted on said second member, and a flexible power supply connected between said carriage and said controls provides the power for operating said lift and tool handling head.

* * * * *